US005944514A

United States Patent [19]

Pohl et al.

[11] Patent Number: 5,944,514

[45] Date of Patent: Aug. 31, 1999

[54] PROCESS AND DEVICE FOR INTRODUCING BULK MATERIAL INTO A ROTARY HEARTH FURNACE

[75] Inventors: Ulrich Pohl, Mülheim; Hermann Cepin, Duisburg; Hartmut Schmieden, Issum; Gerd Herre, Oberhausen, all of Germany

[73] Assignee: Mannesmann Aktiengesellschaft, Düsseldorf, Germany

[21] Appl. No.: 09/011,355

[22] PCT Filed: Jul. 24, 1996

[86] PCT No.: PCT/DE96/01442

§ 371 Date: Apr. 21, 1998

§ 102(e) Date: Apr. 21, 1998

[87] PCT Pub. No.: WO97/05439

PCT Pub. Date: Feb. 13, 1997

[30] Foreign Application Priority Data

Aug. 1, 1995 [DE] Germany ..... 195 29 925

[51] Int. Cl.[6] ..... F27B 9/16

[52] U.S. Cl. ..... 432/138; 414/588

[58] Field of Search ..... 432/87, 138, 124, 432/141; 414/160, 162, 586, 587, 588

[56] References Cited

U.S. PATENT DOCUMENTS

| | | | |
|---|---|---|---|
| 3,667,746 | 6/1972 | Makarov et al. | 266/21 |
| 3,988,012 | 10/1976 | Jemal | 266/179 |
| 4,579,525 | 4/1986 | Ross | 432/138 |
| 5,019,689 | 5/1991 | Bollier et al. | 432/138 |

*Primary Examiner*—Teresa Walberg
*Assistant Examiner*—Gregory A. Wilson
*Attorney, Agent, or Firm*—Cohen, Pontani, Lieberman & Pavane

[57] ABSTRACT

A process for feeding bulk material onto a belt of a rotary hearth furnace, which has hoods that cover the hearth belt in such a manner as to form a ring.

The bulk material is deposited on a transport device at a layer thickness proportionately dependent on the distance to the rotary hearth center. The transport speed of the transport device is set at a certain value; the surface of the bulk material is smoothed; and then the bulk material is distributed at a constant layer height over the entire width of the hearth belt.

11 Claims, 2 Drawing Sheets

PROCESS AND DEVICE FOR INTRODUCING BULK MATERIAL INTO A ROTARY HEARTH FURNACE

BACKGROUND OF THE INVENTION

1. Field of the Invention

The invention relates to a process for feeding bulk material onto a belt of a rotary hearth furnace that has hoods which cover the belt 58 as to form a ring, as well as a suitable device for this purpose.

2. Discussion of the Prior Art

Furnaces of this type demand an even temperature in the furnace chamber at the lowest possible consumption of energy. The removal device and, especially, the charging device, are of particular importance in this regard. From DE 33 12 467 C2, for example, a furnace for heating material is known that has a transport device in the area of the door opening for the purpose of feeding and removing the material, as well as a plurality of gripping devices that can feed the material to be heated from the transport device through the furnace openings to the contents of the hearth support located in the furnace, or remove the material. This known furnace is a so-called hearth bogie furnace, i.e., one in which material is not transported on a circular conveyor.

From EP 0 058 736 B1, a rotary hearth furnace with a heating device to produce a hot zone is known, which has a device that constitutes a feed-in station, via which parts can be introduced into the furnace.

Neither of these devices makes it possible to place bulk materials onto the furnace belt. Such a device is known from EP 0 259 510 B1. In this case, a screw device is used; however, this device is used to carry away the material.

Here, too, as is generally the case, the feeding of the bulk material is carried out by means of transport belts or chutes. In the present case, the material is passed onto the hearth belt via a lid (not described further).

SUMMARY OF THE INVENTION

The object of present the invention is to provide a process and a corresponding device for covering the belt of a rotary hearth furnace with bulk material at a very low layer thickness relative to the belt width, in a careful and reliable manner.

Pursuant to this object, and others which will become apparent hereafter, one aspect of the present invention resides in a process for feeding bulk material onto a belt of a rotary hearth furnace which has hoods that cover the hearth belt so as to form a ring. The process includes the steps of depositing the bulk material on a transport device at a layer thickness proportionally dependent on a distance to a center of the rotary part so that a cross-sectional area of the bulk layer material conically tapers to the center of the hearth, setting the transport device to a speed at least three times greater than that of the hearth belt, smoothing the surface of the bulk material on the transport device, and distributing the bulk material on the hearth belt at a constant layer height over the entire width of the hearth belt.

Another aspect of the invention resides in a device for feeding bulk material onto a hearth belt of a rotary hearth furnace. The device includes hoods that cover the hearth belt so as to form a ring. The ring has a cutout at a feeding point of the rotary hearth furnace. Means are provided for transporting the bulk material. The transporting means are arranged above the hearth belt and have a material discharge edge arranged perpendicular to a direction of movement of the hearth belt. The transport means operate at a transport speed which can be set, relative to the hearth belt speed, inversely proportional to layer heights of the bulk material. Furthermore, means are arranged in an area of the discharge edge of the transport device for smoothing a surface of the bulk material. The smoothing means is arranged at an angle relative to a middle of the rotary hearth furnace above the transport device so as to define a constant cross-sectional area of the bulk material. Finally, means are arranged in front of the smoothing means in the transport direction for depositing the bulk material in a cross-section that tapers conically to the hearth center.

According to the invention, the feed-in device is constructed so that material supply is divided up into different steps. The individual steps can be easily monitored and the individual step transitions reliably controlled.

In a first step, material is supplied evenly in a constant amount. For example, a movable transport belt is used, the discharge quantity of which is monitored and the discharge position of which is adjustable. The position of the turnover point is controlled in such a way that a material layer, the height of which depends on the structure of the rotary hearth furnace and, here, on the size of the furnace belt, is established (Step 2) on a further transport device. The fact that the individual belt positions have different transport speeds depending on their distance to the rotary hearth center is taken into account. The layer height on this transport device is thus highest at the outside of the furnace belt, which is most distant from the furnace center. All told, the layer height has a cross-sectional area in the form of a quadrangle that narrows conically toward the furnace center.

The exact surface form is established by a smoothing device. This transport device is operated at a predeterminable speed. By means of the smoothing device and the constant speed, it is possible to set a fixed transport quantity, which is established directly from its position in the cross-sectional area of the discharge relative to the distance to the furnace center.

In the third step, the material is carefully discharged from the aforementioned transport means onto the hearth belt at the discharge point. The speed of the hearth belt relative to the speed of the transport means now determines the layer height; specifically, in a constant fashion over the full width of the furnace belt.

By simply maintaining the conical cross-sectional area of the bulk material on the transport belt, it is possible, because of the exclusive dependence of the speeds of the furnace belt and the transport belt, to constantly set the layer height in an especially low and reliable fashion.

In practice, layer heights of only 30 mm are demanded on the transport belt for furnace belt widths of up to 7 m. Such high accuracy is attained by the device according to the invention, with layer heights from 200 to 400 mm being provided on the transport belt. The device according to the invention is particularly suitable for large-grain bulk materials.

Instead of a movable continuous belt, a swivelling belt can also be used as the first material supplier.

Advantageously, a continuous belt is used as the transport unit. This can have edge-shaped elevations directly on its edges; or else a side slat is provided, regardless of the transport belt. Given this side limit, it is possible to place bulk material on the transport belt at exactly the height desired.

Depending on the material quality, it is also possible to carefully transport the bulk material by means of a vibrating conveyor that has a fixed strip on the side. The vibrational frequency is set so that the conical cross-sectional area is maintained.

An example of material distribution on the furnace belt is illustrated by the following example:

For example, if a furnace belt with a width of 6 to 7 m is used for a rotary hearth furnace having a diameter of approximately 35 m, in 6 total segments of a cut-out, for instance, a circular cut-out of approximately 3°, then the sixth and outermost segment is covered by a bulk weight of roughly 36 kg and a total weight of only around 25 kg, corresponding to roughly 70%, is required in the inner segment.

BRIEF DESCRIPTION OF THE DRAWINGS

An example of the invention is shown in the accompanying drawings. The drawings show.

DETAILED DESCRIPTION OF THE PREFERRED EMBODIMENTS

Figure 1:
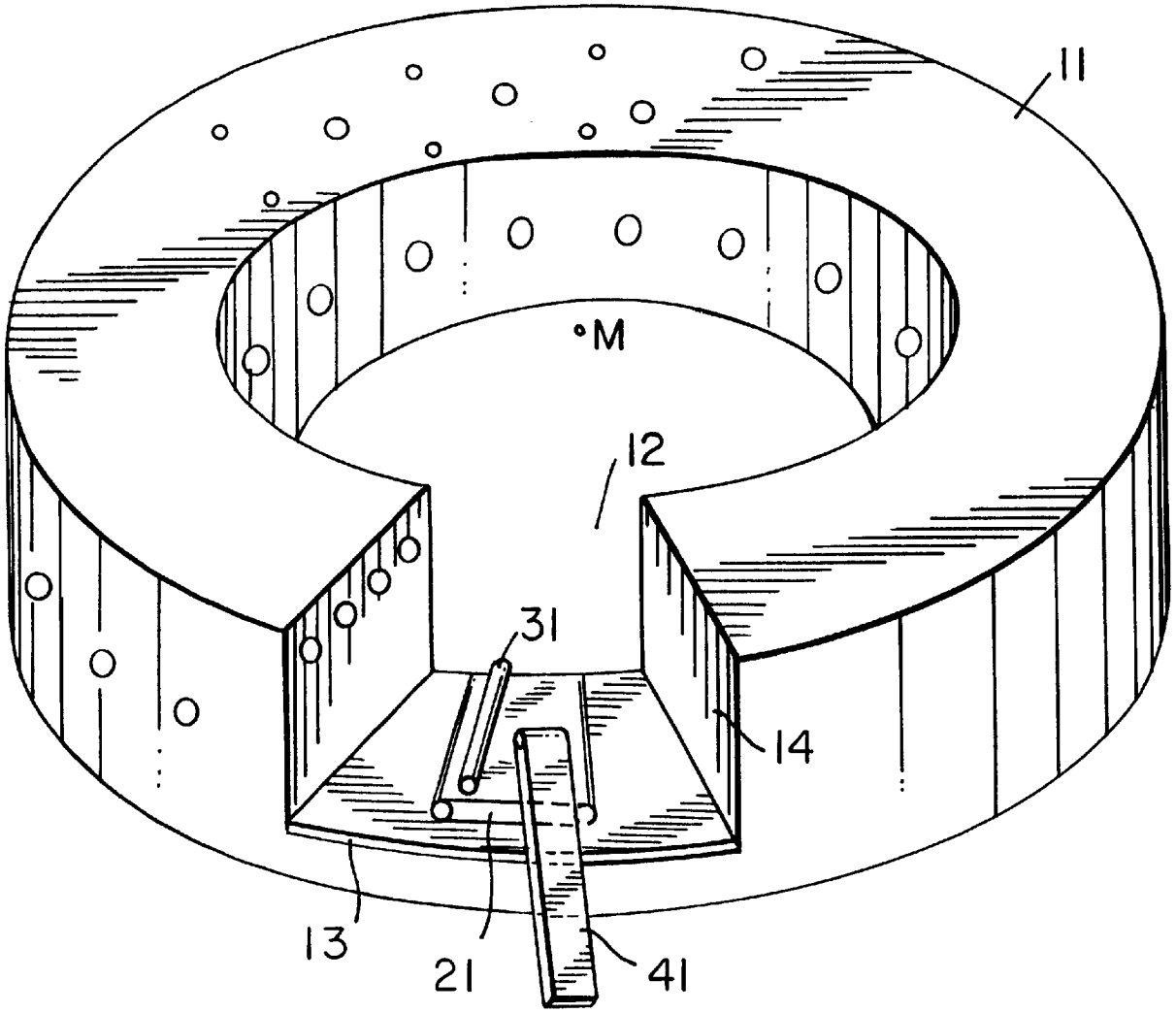
FIG. 1 is an overview of a rotary hearth furnace.

FIG. 1 shows a rotary hearth furnace 11 with a midpoint M, the material transport belt 13 of which is covered by a hood 14.

A hood cut-out 12 is provided for the feeding device.

Figure 2:
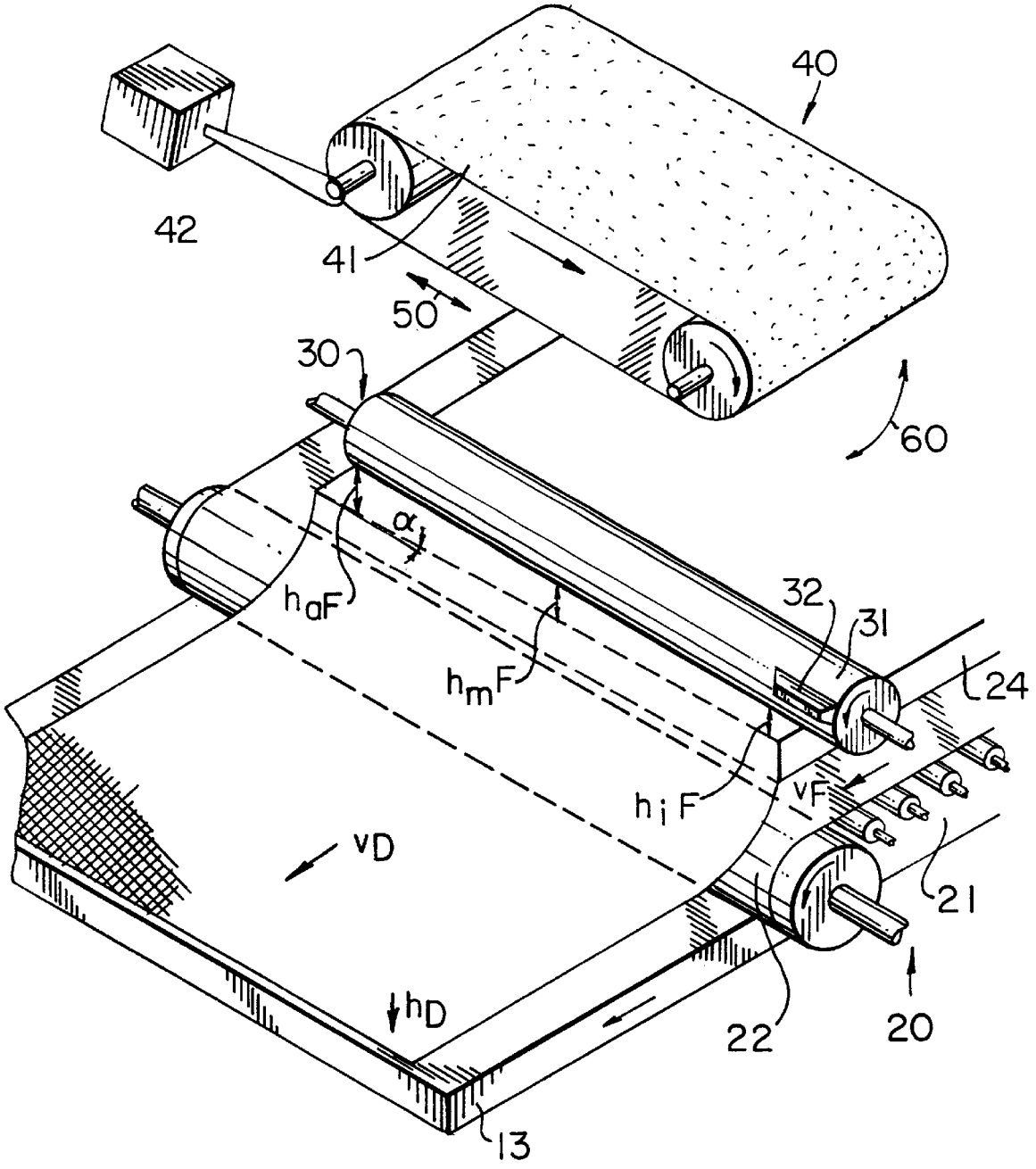
FIG. 2 The diagram of the feeding device.

FIG. 2 shows a section of the hearth belt 13, which moves at the speed $V_D$. The hearth belt 13 is covered by bulk material at a height $h_D$.

Above the hearth belt 13, there is a continuous belt 21 of a transport device 20 covered by with the bulk material which has a height $h_{iF}$ on the side toward the center of the rotary hearth furnace; a height $h_{mF}$ in the center; and a height $h_{aF}$ in the outer area. The continuous belt 21 moves at the speed $v_F$ which is at least three times greater than the hearth belt speed.

The surface of the material is passed under a smoothing roller 31 of a smoothing device 30 arranged at an angle. Below the underside of the smoothing roller 31, there are limits in the form of limit slats 24 in the edge area of the continuous belt 21. On the smoothing roller 31, distributed over its axial length, there are elastic blades 32, which serve to distribute the material on the continuous belt 21. The belt 21 feeds the material to a discharge edge 22 where the material falls to the hearth belt 13.

In the transport direction of the continuous belt 21, in front of the smoothing roller 31 and above the continuous belt 21, there is a transport belt 41, and a drive 42 of a material supply device 40. As the arrows 50 indicate, the transport belt 41 can be moved back and forth.

In addition, the transport belt 41 can be swivelled around an axis lying outside of the rotary hearth furnace. This is also indicated in the drawing by a double arrow 60. This swivelling serves to improve the material supply onto the continuous belt; particularly, to achieve different bulk heights.

What is claimed is:

1. A process for feeding bulk material onto a belt of a rotary hearth furnace which has hoods that cover the hearth belt so as to form a ring, comprising the steps of:

depositing the bulk material on a transport device at a layer thickness proportionately dependent on a distance to a center of the rotary hearth so that a cross-sectional area of the bulk material layer conically tapers to the center of the hearth;

setting the transport device to a speed at least three times greater than that of the hearth belt;

smoothing the surface of the bulk material on the transport device; and distributing the bulk material on the hearth belt at a constant layer height over the entire width of the hearth belt.

2. A process as defined in claim 1, wherein the depositing step includes depositing the bulk material on the transport device in lines in a form dependent on the layer thickness.

3. A process as defined in claim 1, wherein the smoothing step includes pushing the bulk material into troughs.

4. A process as defined in claim 1, wherein the smoothing step includes vibrating the bulk material.

5. A device for feeding bulk material onto a hearth belt of a rotary hearth furnace, comprising:

hoods that cover the hearth belt so as to form a ring, the ring formed of hoods having a cutout at a feeding point of the rotary hearth furnace;

means for transporting the bulk material arranged above the hearth belt and having a material discharge edge arranged perpendicular to a direction of movement of the hearth belt, the transport means having a transport speed which, relative to the hearth belt speed can be set inversely proportional to layer heights of the bulk material;

means arranged in an area of the material discharge edge of the transport device for smoothing a surface of the bulk material, the smoothing means being at an angle relative to a middle of the rotary hearth furnace above the transport device so as to define a constant cross-sectional area of the bulk material; and means arranged in front of the smoothing means in the transport direction, for depositing the bulk material in a cross-section that tapers conically to the hearth center.

6. A device as defined in claim 5, wherein the transport means includes a continuous belt having edges, a limit being provided at the edges at a height corresponding to the bulk material height.

7. A device as defined in claim 5, wherein the transport means includes a vibrating conveyor and limit slats arranged in an edge area of the conveyor at a height corresponding to the bulk material height.

8. A device as defined in claim 5, wherein the smoothing means includes a roller arranged parallel to the material discharge edge and driveable counter to the transport direction of the bulk material.

9. A device as defined in claim 8, wherein elastic blades are mounted to the outer surface of the smoothing roller.

10. A device as defined in claim 5, wherein the smoothing means includes a strip arranged parallel to the material discharge edge.

11. A device as defined in claim 5, wherein the bulk material depositing means includes a swivelling transport belt having a swivelling drive, the transport belt having an adjustable swivelling angle and swivelling speed.

* * * * *